United States Patent [19]

Turner

[11] 4,121,551

[45] Oct. 24, 1978

[54] DRAIN RECYCLE SYSTEM FOR TWO-CYCLE ENGINE

[75] Inventor: Robert K. Turner, Zion, Ill.

[73] Assignee: Outboard Marine Corporation, Waukegan, Ill.

[21] Appl. No.: 709,390

[22] Filed: Jul. 28, 1976

[51] Int. Cl.[2] ..... F02B 75/20

[52] U.S. Cl. ..... 123/59 B; 123/73 A; 123/196 CP

[58] Field of Search ..... 123/DIG. 2, 73 R, 73 A, 123/73 AD, 196 CP, 59 B

[56] References Cited

U.S. PATENT DOCUMENTS

| | | | |
|---|---|---|---|
| 1,606,424 | 11/1926 | Irgens et al. | 123/196 CP |
| 2,128,065 | 8/1938 | Aikman | 123/196 CP |
| 2,936,748 | 5/1960 | Jensen | 123/196 CP |
| 2,959,164 | 11/1960 | Janeway et al. | 123/196 CP |
| 2,983,334 | 5/1961 | Dalrymple | 123/196 CP |
| 3,805,751 | 4/1974 | Resnick et al. | 123/73 R |
| 3,859,967 | 1/1975 | Turner et al. | 123/73 A |
| 3,929,111 | 12/1975 | Turner et al. | 123/DIG. 2 |

*Primary Examiner*—Charles J. Myhre

*Assistant Examiner*—David D. Reynolds

*Attorney, Agent, or Firm*—Michael, Best & Friedrich

[57] ABSTRACT

Disclosed herein is a two-cycle internal combustion engine including a cylinder having a fuel intake port, an exhaust port, and an inlet port located intermediate the intake port and the exhaust port, a piston reciprocably mounted in the cylinder, a crankcase having a drains collecting area, and a conduit means connected in liquid communication with the drains collecting area and with the inlet port, whereby the drains are recycled or recirculated from the drains collecting area to the cylinder for ultimate combustion therein in response to the cyclical variation of pressure in the crankcase and in the cylinder.

In a preferred embodiment, the conduit means includes a first conduit which is connected in liquid communication with the drains collecting area and with an upper bearing rotatably supporting the engine crankshaft and a second conduit which is connected in liquid communication with the upper bearing and with the inlet port such that the recirculating drains contact and lubricate the upper bearing enroute to the cylinder.

5 Claims, 3 Drawing Figures

DRAIN RECYCLE SYSTEM FOR TWO-CYCLE ENGINE

BACKGROUND OF THE INVENTION

This invention relates to internal combustion engines and, more particularly, to two-cycle internal combustion engines employing crankcase scavenging and wherein liquid drains accumulate in the crankcase.

Crankcase scavenged, two-cycle internal combustion engines commonly experience an accumulation of fuel and lubricant, or so-called "drains", in the low point or sump of the engine crankcase. The desirability of recycling or returning the drains to the engine for ultimate combustion has been known for some time. Such recycling is particularly important for avoiding the pollution problem associated with outboard motors when the drains are wasted overboard into the water by being dumped into the exhaust system.

Examples of prior drain arrangements are disclosed in the following U.S. Pat. Nos.

Upton, 2,717,584, issued Sept. 13, 1955
Goggi, 3,128,748, issued Apr. 14, 1964
Heidner, 3,132,635, issued May 12, 1964
Goggi, 3,170,449, issued Feb. 23, 1965
Goggi, 3,528,395, issued Sept. 15, 1970
Brown, 3,709,202 issued Jan. 9, 1973
Brown, 3,703,149, issued May 1, 1973
Schultz, 3,762,380, issued Oct. 2, 1973
Sullivan et al., 3,800,753 issued Apr. 2, 1974
Resnick et al., 3,805,751 issued Apr. 23, 1974
Turner et al., 3,859,967 Jan. 14, 1975

SUMMARY OF THE INVENTION

The invention provides an arrangement for recycling drains accumulated in the crankcase of a two-cycle internal combustion engine to the engine cylinders for ultimate combustion, which arrangement utilizes the combined effect of the cyclical pressure condition created in the crankcase and in the combustion chamber.

The invention is applicable to both single cylinder and multiple cylinder engines. In single cylinder engines, an inlet port is provided in the cylinder intermediate the fuel intake port and the exhaust port thereof and this inlet port is connected by a conduit means in communication with an area of the crankcase in which the drains collect. The drains are pumped from the drains collecting area into the conduit means by the high pressure created in the crankcase as the piston approaches bottom dead center during the expansion stroke. Simultaneously, while the piston is approaching bottom dead center after an exhaust port has been opened and before the intake port is opened, the negative pressure created in the cylinder is communicated to the conduit means through the inlet port. This causes the drains in the conduit means to be sucked or withdrawn into the cylinder for ultimate combustion, along with the fuel mixture introduced into the cylinder through the intake port, during the subsequent stroke of the piston.

In accordance with a preferred embodiment, the conduit means includes a first conduit or passage communicating between the drains collecting area in the cranckcase and an upper bearing rotatably supporting the crankshaft and a second conduit or passage communicating between the upper bearing and the inlet port so that the recirculating drains flow in contact and lubricate the upper bearing enroute to the cylinder. In one embodiment, one-way check valve means is provided in the first conduit or passage for permitting flow from the drains collecting area to the upper bearing and for preventing flow from the upper bearing to the drains collecting area.

In the preferred construction in accordance with the invention, the crankshaft is arranged vertically and the drains collecting area comprises an annular collector ring or sump located in the crankcase adjacent and coaxially with the crankshaft and the inlet of the first conduit or passage is connected in liquid communication with the sump, either directly to the sump, to a cavity in which the lower crankshaft bearing is received and which communicates with the sump, or to both the sump and the lower crankshaft bearing cavity.

In a multiple cylinder engine, an inlet port is provided in one of the cylinders intermediate the fuel intake port and the exhaust port thereof and this inlet port is connected by a conduit means in communication with a drains collecting area in each of the crankcases. The conduit means includes a first conduit or passage communicating with the inlet port and with the drains collecting area of the crankcase associated with the cylinder including the inlet port and a second conduit or passage communicating with the first conduit or passage and with the drains collecting area of the crankcase or crankcases associated with the other cylinder or cylinders. One-way check valve means are provided in each of the conduit or passages for permitting flow from the respective drains collecting area toward the inlet port when a positive pressure condition exists in the associated crankcase during the compression stroke of the associated piston and for preventing reverse flow into the drains collecting area when a reduced pressure exists in the associated crankcase during the compression stroke of the associated piston.

One of the principal features of the invention is the provision of a means in a two-cycle internal combustion engine for effectively recycling the drains accumulated in the crankcase to a cylinder for ultimate combustion.

Another principal feature of the invention is the provision of a two-cycle, internal combustion engine including means for pumping drains from a drains collecting area in the crankcase to a cylinder for combustion therein in response to the pressure variations occurring in the crankcase and in the cylinder during reciprocation of the piston.

Still another principal feature of the invention is the provision of a two-cycle internal combustion engine as described in the previous paragraph including means arranged to provide lubrication of an upper bearing rotatably supporting the crankshaft by the drains being recycled or recirculated to the cylinder.

Other features and advantages of the embodiments of the invention will become apparent upon reviewing the following detailed description, the drawing and the appended claims.

Figure 1:
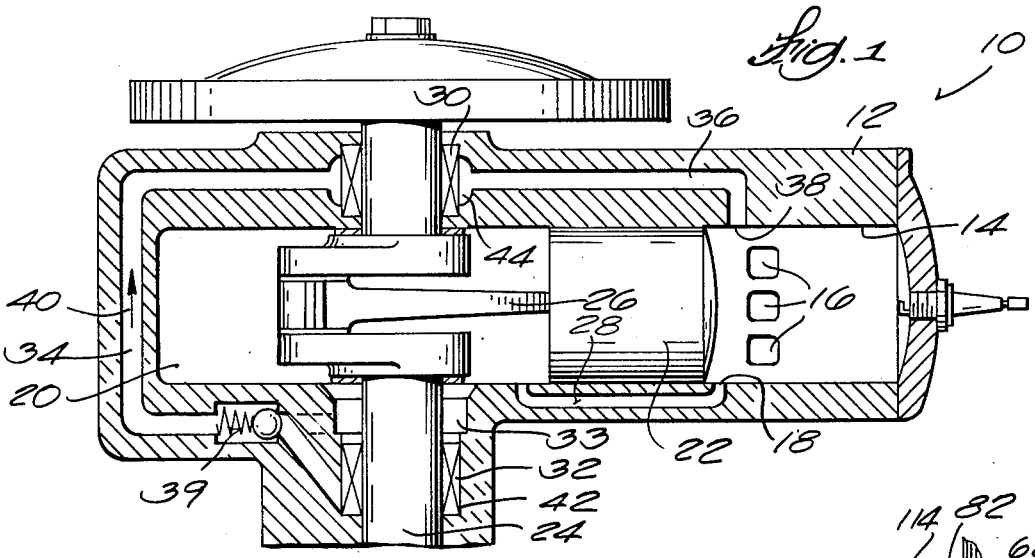
FIG. 1 is a diagrammatic view, partially in section, of a single cylinder, twio-cycle internal combustion engine embodying various of the features of the invention.

Before explaining at least one embodiment of the invention in detail, it is to be understood that the invention is not limited in its application to the details of construction and the arrangements of the componenets set forth in the following description or illustrated in the drawing. The invention is capable of other embodiments and of being practiced and carried out in various ways. Also, it is to be understood that the phraseology and terminology employed herein is for the purposes of description and should not be regarded as limiting.

DESCRIPTION OF THE PREFERRED EMBODIMENTS

Illustrated in FIG. 1 is a single cylinder, two-cycle internal combustion engine 10 including an engine block 12 defining a cylinder 14 which has one or more exhaust ports 16 and an intake port 18 and a crankcase 20. Reciprocally movable in the cylinder 14 is a piston 22 connected to a crankshaft 24 by a connecting rod 26.

The intake port 18 comprises the terminus of a transfer passage 28 which communicates with the crankcase 20 and through which fuel is supplied to the cylinder 14 for combustion. A fuel-lubricant-air mixture is introduced into the crankcase 20 through a carburetor (not shown) and a reed valve (not shown). This mixture is periodically pumped from the crankcase 20 into the cylinder 14 through the transfer passage 28 in a normal manner, i.e., when the intake port 18 is open and the pressure inside the crankcase 20 is increased due to the approach of the piston 22 to bottom dead center.

The crankshaft 24 is supported for rotation within the crankcase 20 by an upper bearing 30 and a lower bearing 32 vertically spaced from the upper bearing 30.

Provided in the crankcase 20 is a suitable means defining an area in which drains collect. In the specific construction illustrated, the crankshaft 24 is verticaly arranged and an annular collector ring or sump 33 is provided in the bottom poriton of the crankcase 20 adjacent and coaxially with the crankshaft 24.

The drains which accumulate in the sump 33 are pumped therefrom and recirculated to the cylinder 14 for ultimate combustion, preferably after first flowing in contact with the upper bearing 30. Provided for this purpose is a first conduit or passage 34 connected in liquid communication with the sump 33 and with the upper bearing 30 and a second conduit or passage 36 connected in communication with the upper bearing 30 and with an inlet port 38 provided in the cylinder 14 at a location between the intake port 18 and the exhaust port 16. Thus, the crankcase 20 is closed except for the connection to the transfer passage 28, for communication through the reed valve, and for communication through the first passage 34.

Located in the first passage 34 is a suitable one-way check valve means, such as a ball check valve 39, which operates to permit flow of the accumulated drains from the sump 33 when a positive pressure exists in the crankcase 20 and to prevent reverse flow of the drains from the upper bearing 30 to the sump 33 when a low pressure condition exists in the crankcase 20.

The accumulated drains are recirculated to the cylinder 14 by a combined pumping action and a sucking action. That is, a positive pressure is created in the crankcase 20 as the piston 22 approaches bottom dead center during the downstroke or expansion stroke of the piston. This positive pressure forces the drains accumulated in the sump 33 through the check valve 39 and the first passage 34 in the direction of the arrow 40. Simultaneously, while the piston 22 is approaching bottom dead center and after the exhaust port 16 has opened and before the intake port 18 is opened, a negative pressure exists in the cylinder 14. This negative pressure condition is communicated through the inlet port 38 to the second passage 36 and to the first passage 34, thereby tending to suck or withdraw the drains therefrom into the cylinder 14.

After the inlet port 38 has been closed by the piston 22, the negative pressure created in the crankcase 20 causes closure of the check valve 39, thereby preventing the return flow to the crankcase 20 of any drains remaining in the first passage 34 downstream of the check valve 39, in the area of the upper bearing 30, and in the second passage 36.

The inlet of the first passage 34 can be connected in communication with a cavity 42 provided in the engine block 12 for receiving the lower crankshaft bearing 32 (either to the bottom portion of the bearing cavity 42 as shown by the solid lines or to the upper portion of the bearing cavity), or connected in direct communication with the sump 33 as shown by the dashed lines, or connected in communication with both the bearing cavity 42 and the sump 33.

In the first case, the bearing cavity 42 is connected in communication with the sump 33, either by the tolerance between the crankshaft 24 and the engine block 22 or by a separate port (not shown), so as to permit the drains accumulated in the sump 33 to flow or drain into the bearing cavity 42 and lubricate the lower bearing 32 prior to being recirculated to the cylinder 14. In the second case, the sump 33 can be arranged to prevent leakage of the accumulated drains therefrom, such as by providing a seal (not shown) between the sump 33 and the lower bearing 42, and the drains are recirculated directly from the sump 33. In the last case, a portion of the accumulated drains flows or drains into the bearing cavity 42 to lubricate the lower bearing 32 prior to being recirculated and the other portion is recirculated directly from the sump 33.

To insure adequate lubrication of the upper bearing 30 by the recirculating drains without causing an undue restriction to flow, an annular plenum chamber 44 surrounding the upper bearing 30 preferably is provided in the engine block 12 as shown. The recirculating drains flowing through the plenum chamber 44 contact and lubricate the upper bearing 30 enroute to the second passage 36.

Figure 2:
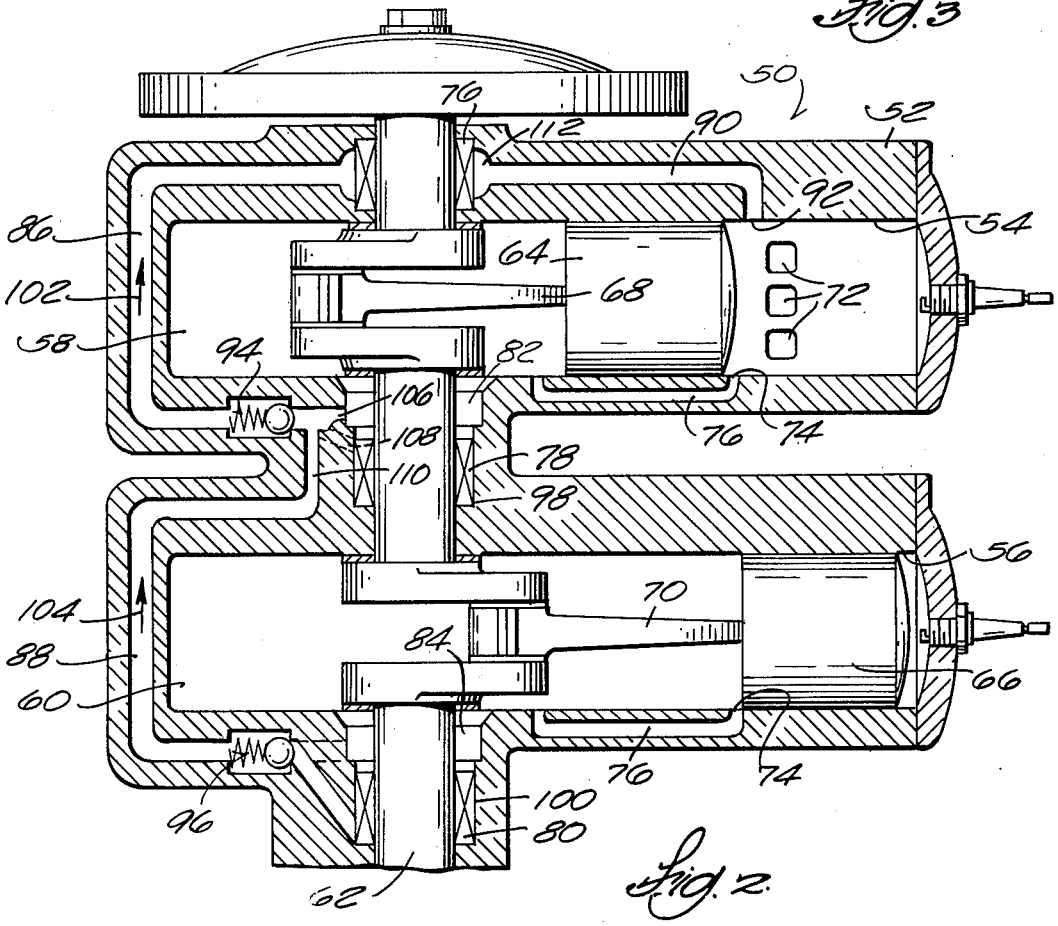
FIG. 2 is a diagrammatic view, partially in section, of an alternately acting, two-cylinder, two-cycle internal combustion engine embodying various of the features of the invention.

In the embodiment illustrated in FIG. 2, the multiple cylinder engine includes a conventional engine block 52 defining two cylinders 54 and 56, to respectively associated crankcases 58 and 60, a crankshaft 62 extending through the crankcases, separate pistons 64 and 66 reciprocally movble in the respective cylinders 54 and 56, and separate connecting rods 68 and 70 respectively connecting the pistons 64 and 66 to the crankshaft 62 in a manner to effect opposite action of the pistons. Each of the cylinders 54 ad 56 has one or more exhaust ports 72 and an intake port 74 which is the terminus of a transfer passage 76 which serves the same function as a transfer passage 28 described above.

The crankshaft 62 is supported for rotation within the crankcases 58 and 60 by vertically spaced upper bearing 76, intermediate bearing 78, and lower bearing 80.

Drains which accumulate in the crankcases 58 and 60 are collected in respective sumps 82 and 84 which are arranged in the same manner as the sump 33 in FIG. 1. These drains are recycled or recirculated from the sumps 82 and 84 to the upper cylinder 54 for ultimate combustion, preferably after first flowing in contact with the upper bearing 76. Provided for this puprose is a first conduit or passage 86 which is connected in liquid communication with the sump 82 and with the upper bearing 76, a second conduit or passage 88 which is connected in liquid communication with the sump 84 and with the first passage 86, and a third conduit or passage 90 which is connected in communication with the upper bearing 76 and with an intake port 92 provided in the upper cylinder 54 at a location between the intake port 74 and the exhaust port 72 thereof.

Located in the first and second passages 86 and 88 are suitable one-way check valve means, such as ball check valves 94 and 96, which operate to permit flow of the drains from the respective sumps 82 and 84 when a positive pressure condition exists in the associated crankcase and to prevent reverse flow of the drains into the respective sumps 82 and 84 when a low pressure condition exists in the associated crankcase.

The inlet portions of the first and second passages 86 and 88 can be connected in communication with the respective sumps 82 and 84 as shown by the solid lines, or connected in communication with respective cavities 98 and 100 provided in the engine block 52 for receiving the intermediate bearing 78 and the lower bearing 80 as shown by the dashed lines, or connected in communication with both the respective sumps 82 and 84 and the respective bearing cavities 98 and 100 in the same general manner as described above.

Drains accumulated in the sumps 82 and 84 ar recirculated to the upper cylinder 54 by a combined pumping action in each of the crankcases 58 and 60 and a suction action in the upper cylinder 54. That is, as the upper piston 64 approaches bottom dead center during the down stroke or expansion stroke, the positive pressure created in the upper crankcase 58 forces the drains accumulated in the sump 82 and/or the intermediate bearing cavity 98 through the check valve 94 and through the first passage 86 toward the upper main bearing 76 in the direction of the arrow 102. As described above, a negative pressure is simultaneously created in the upper cylinder 54 and this negative pressure is communicated through the inlet port 92 to the third passage 90 and to the first passage 86 during the time interval the inlet port 92 is open, thereby tending to suck or withdraw the drains previously delivered to the first passage 86, the upper bearing 76 and the third passage 90 into the upper cylinder 54.

At the same time, the oppositely acting lower piston 66 is moving toward top dead center, creating a low pressure condition in the lower crankcase 60. The check valve 96 closes to prevent the flow of drains from the sump 82 into the sump 84 and/or the bearing cavity 100.

When the upper piston 64 subsequently moves toward top dead center and the lower piston 66 subsequently moves toward bottom dead center, the positive pressure created in the lower crankcase 60 forces the drains accumulated in the sump 84 and/or the lower bearing cavity 100 through the check valve 96, through the second passage 88 in the direction of the arrow 104 and through the check valve 94 toward the upper main bearing 76. Since the inlet port 92 is closed during most of this cycle, some of the drains delivered to the first passage 86, the upper bearing 76 and the third passage 90 will not enter the cylinder 54 until the subsequent expansion stroke of the upper piston 64.

Suitable means are provided for preventing the drains being pumped through the second passage 88 during the expansion stroke of the lower piston 66 from flowing into the sump 82 and/or the intermediate bearing cavity 98. In the construction in FIG. 2, such means comprises providing the inlet portions 106 and 108 of the first passage 86 with a restricted portion which has cross-sectional area smaller than the cross-sectional area of the first passage 86. These restricted portions are sized to provide a flow resistance which is substantially higher than the flow resistance of the first passage 86, thereby minimizing the flow of drains from the second passage 88 into the sump 82 and/or the intermediate bearing cavity 98. To minimize flow of drains from the sump 82 into the second passage 88 during the expansion stroke of the upper piston 64, the outlet portion 110 of the second passage 88 connected in communication with the first passage 86 can be provided with a cross-sectional area smaller than the cross-sectional area of the first passage 86.

As with the embodiment illustrated in FIG. 1, an annular plenum chamber 112 surrounding the upper bearing 76 preferably is provided in the engine block 52 so as to insure adequate lubrication of the upper bearing 76 by the recirculating drains without causing an undue restriction to flow.

Figure 3:
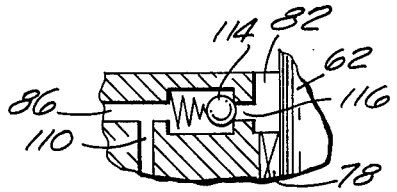
FIG. 3 is an enlarged, fragmentary view of an alternate arrangement for connecting the drains passage of the upper cylinder of the engine in FIG. 1 with the drains collecting area.

In the alternate arrangement illustrated in FIG. 3, a suitable one-way check valve means, such as a ball valve 114, is provided in the inlet portion 116 of the first passage 86 connected in communication with the sump 82. The check valve 114 operates to permit flow of drains from the sump 82 into the first passage 86 during the expansion stroke of the upper piston 64 and to prevent flow from the second passage 88, via the outlet portion 110, into the sump 82 during the expansion stroke of the lower piston 66 and the compression stroke of the upper piston 64.

While the embodiments illustrated in FIG. 2 and 3 have been described with respect to a two-cylinder engine, it is obvious that the same principles can be applied to any multiple cylinder engine having a sequential firing order.

Various of the features of the invention are set forth in ythe following claims.

What is claimed is:

1. A two-cycle internal combustion engine including a pair of generally closed, separate crankcases, each having an area in which drains collect, separate cylinders extending from each of said crankcases, separate oppositely acting pistons reciprocally movable in each of said cylinders whereby there is alternately developed in said crankcases a low pressure condition as the associated one of said pistons approaches top dead center and a high pressure condition as the associated one of said piston approaches bottom dead center, a separate intake port in each of said cylinders for admitting a fuel-lubricant mixture thereinto when the associated one of said pistons is adjacent bottom dead center, an exhaust port in each of said cylinders for exhausting combustion products therefrom as the associated one of said pistons approaches bottom dead center, an inlet port located in one of said cylinders between said intake port and said exhaust port thereof, first conduit means connected in communication with said drains collecting area associated with said one of said cylinders and with said inlet port, second conduit means connected in communication with said first conduit means and with said drains collecting area associated with the other of said cylinders, whereby the drains are recirculated from said drain collecting areas to said one of said cylinders through said inlet port in reponse to cyclical variation in said crankcases and in said one of said cylinders, and check valve means in each of said first and second conduit means for permitting flow from the associated one of said drain collecting areas toward said inlet port during a high pressure condition in the associated one of said crankcases and for preventing flow from the associated one of said first and second conduit means into the associated one of said drains collecting areas during a low pressure condition in the associated one of said crankcases.

2. A two-cycle internal combustion engine according to claim 1 wherein said engine includes a vertically extending crankshaft and an upper bearing rotatably supporting said crankshaft, and wherein said first conduit means includes a first portion connected in liquid communication with said upper bearing, with said second conduit means, and with said drains collecting area associated with said one of said cylinders, and a second portion connected in liquid communication with said upper bearing and said inlet port such that the recirculating drains contact and lubricate said upper bearing enroute to said one of said cylinders.

3. A two-cycle internal combustion engine according to claim 2 wherein each of said drains collecting area comprises an annular sump located in the respective one of said crankcases adjacent and coaxially with said crankshaft.

4. A two-cycle internal combustion engine according to claim 3 wherein said engine further includes vertically spaced intermediate said lower bearings rotatably supporting said crankshaft and separate cavities in which said intermediate bearing and said lower bearing are received and which are in communication with the associated one of said sumps, wherein said second conduit means include an inlet portion connected in communication with said lower bearing cavity, and wherein said first portion of said first conduit means includes an inlet portion connected in communication with said intermediate bearing cavity.

5. A two-cycle internal combustion engine according to claim 4 wherein the inlet portion of said second conduit means is also connected in direct communication with said sump associated with said lower bearing cavity, and wherein the inlet portion of said first portion of said first conduit means is also connected in direct communication with said sump associated with said intermediate bearing cavity.

* * * * *